US005598918A

United States Patent [19]

Malecke et al.

[11] Patent Number: 5,598,918

[45] Date of Patent: Feb. 4, 1997

[54] SWITCH FOR VEHICLE POWER WINDOW

[75] Inventors: Joseph F. Malecke, South Lyon; Dennis D. Kaufman, Farmington; Rodney A. Dale, Westland, all of Mich.

[73] Assignee: TRW Inc., Lyndhurst, Ohio

[21] Appl. No.: 506,779

[22] Filed: Jul. 26, 1995

Related U.S. Application Data

[63] Continuation-in-part of Ser. No. 444,910, May 18, 1995, abandoned.

[51] Int. Cl.[6] ..... H01H 21/82

[52] U.S. Cl. ..... 200/558; 200/553; 200/7; 200/9; 200/5 R; 200/1 B; 200/557

[58] Field of Search ..... 200/553, 556, 200/557, 558, 559, 7, 9, 18, 517, 339, 552, 5 R, 1 B, 521

[56] References Cited

U.S. PATENT DOCUMENTS

| | | | |
|---|---|---|---|
| 4,430,531 | 2/1984 | Wright . | |
| 4,659,881 | 4/1987 | Dowe . | |
| 4,967,043 | 10/1990 | Killarney . | |
| 5,115,108 | 5/1992 | Ogawa et al. | 200/1 B |
| 5,130,506 | 7/1992 | Zuercher et al. . | |
| 5,329,163 | 7/1994 | Satoh et al. | 200/557 |
| 5,343,008 | 8/1994 | Ipcinski | 200/302.2 |
| 5,350,889 | 9/1994 | Lauritsen . | |

FOREIGN PATENT DOCUMENTS

| | | |
|---|---|---|
| 0024813 | 3/1981 | European Pat. Off. . |
| 0100875 | 2/1984 | European Pat. Off. . |
| 0516544 | 12/1992 | European Pat. Off. . |
| 1553772 | 10/1979 | United Kingdom . |
| 2046996 | 11/1980 | United Kingdom . |

*Primary Examiner*—David J. Walczak
*Attorney, Agent, or Firm*—Tarolli, Sundheim, Covell, Tummino & Szabo

[57] ABSTRACT

An apparatus (20) for controlling movement of a vehicle power window (22) between a fully open position and a fully closed position. The apparatus (20) comprises an energizable electric motor (66) for, when energized, moving the window (22). A switch assembly (62) for energizing the electric motor (66) to move the vehicle window (22) to one of the positions. The switch assembly (62) includes a first electrical contact (282) and a second electrical contact (284) electrically insulated from the first electrical contact. An electrically conductive disk (286) has a periphery (288) domed portion (290) and is in electrical communication with one of the first and second electrical contacts (282, 284) at a portion of a periphery of the disk. The other of the first and second electrical contacts (282, 284) is located adjacent the disk (286) and initially spaced from the disk. The disk (286) is resiliently deflectable into engagement with the other of the first and second electrical contacts (282, 284) to provide electrical communication between the first and second electrical contacts. A member (104) is supported for movement and is movable in response to manual force applied thereto. Movement of the member (104) effects deflection of the domed portion (290) of the disk (286) into engagement with the other of the first and second electrical contacts (282, 284) to energize the electric motor (66) to move the window (22) in a direction towards one of the positions.

8 Claims, 7 Drawing Sheets

SWITCH FOR VEHICLE POWER WINDOW

This is a Continuation-In-Part of application Ser. No. 08/444,910, filed on May 18, 1995, now abandoned.

TECHNICAL FIELD

The present invention relates to an electrical switch for controlling movement of a vehicle power window, and particularly to a switch having manual and automatic control features.

BACKGROUND OF THE INVENTION

DESCRIPTION OF THE PRIOR ART

Vehicles with electric power windows typically have a control system with several individual switches. Each switch controls the energization of an electric motor for opening or closing a vehicle window. The switch is typically located near the associated window. The control system also includes a master switch assembly for remotely controlling all of the windows in the vehicle from a single location. The master switch assembly is located near the driver of the vehicle.

One known switch structure used in the control system for a vehicle power window is located in the master switch assembly to control the power window adjacent the driver of the vehicle. The switch includes an actuator which is manually depressed to pivot in opposite directions to engage and close electrical contacts for energizing the motor. The motor raises or lowers the window depending on the direction and distance that the actuator is pivoted. To manually control movement of the window, the actuator is pivoted in one direction a predetermined distance to engage electrical contacts. The user holds the actuator in that position to energize the motor until the window is raised or lowered to a desired position. The pressure on the actuator is then released by the user to stop movement of the window.

The switch is also operatively connected with an actuatable electronic circuit. The circuit continuously energizes the motor to move the window to a fully open position or a fully closed position. Upon initial actuation, the circuit energizes the motor and maintains the energization even after the manual depression force applied to the switch is released. Initial actuation of the circuit typically occurs by pivoting the actuator, at least momentarily, to a position beyond the predetermined distance at which manual control of window movement takes place. This feature is known as "auto-down" or "auto-up".

SUMMARY OF THE INVENTION

The present invention is directed to an apparatus for moving a power window of a vehicle between a fully open position and a fully closed position. The apparatus includes an energizable electric motor for, when energized, moving the window in a desired direction. The apparatus also includes means for energizing the electric motor to move the vehicle window towards one of the fully opened and fully closed positions.

In accordance with the present invention, the means for energizing the electric motor comprises a switch assembly having a first electrical contact. A second electrical contact is electrically insulated from said first electrical contact. An electrically conductive disk having a periphery and a domed portion is in electrical communication with one of the first and second electrical contacts at the periphery of the disk. The other of the first and second electrical contacts is located adjacent the disk and is initially spaced from the domed portion. The domed portion is resiliently deflectable into engagement with the other of the first and second electrical contacts to provide electrical communication between the first and second electrical contacts. A manually movable member is supported for movement in response to a manual force applied thereto to effect the deflection of the domed portion into engagement with the other of the first and second electrical contacts and energize the electric motor.

A second member is supported for movement between the manually movable member and the disk. The second member is moved by the manually movable member to deflect the domed portion into engagement with the other of the first and second electrical contacts. The second member is linearly movable in a direction towards and away from the disk and preferably movable along a path extending substantially normal to the domed portion of the disk. The second member includes an end portion having a convex surface. The manually movable member includes an actuator arm having an end portion with a concave V-shaped surface for engaging the end portion of the second member to move the second member.

The apparatus also includes circuit means for maintaining energization of the electric motor after the domed portion of the disk disengages the other of the first and second contacts. A rocker contact portion is further included to energize the electric motor to move the window in a direction towards the fully open position only when the first member is manually held in a position intermediate a neutral position at which the electric motor is unenergized and the position at which the domed portion is deflected to energize the motor.

BRIEF DESCRIPTION OF THE DRAWINGS

Further features and advantages of the present invention will become apparent to those skilled in the art to which the present invention relates upon reading the following description of the invention with reference to the accompanying drawings, in which.

DESCRIPTION OF PREFERRED EMBODIMENT

Figure 1:
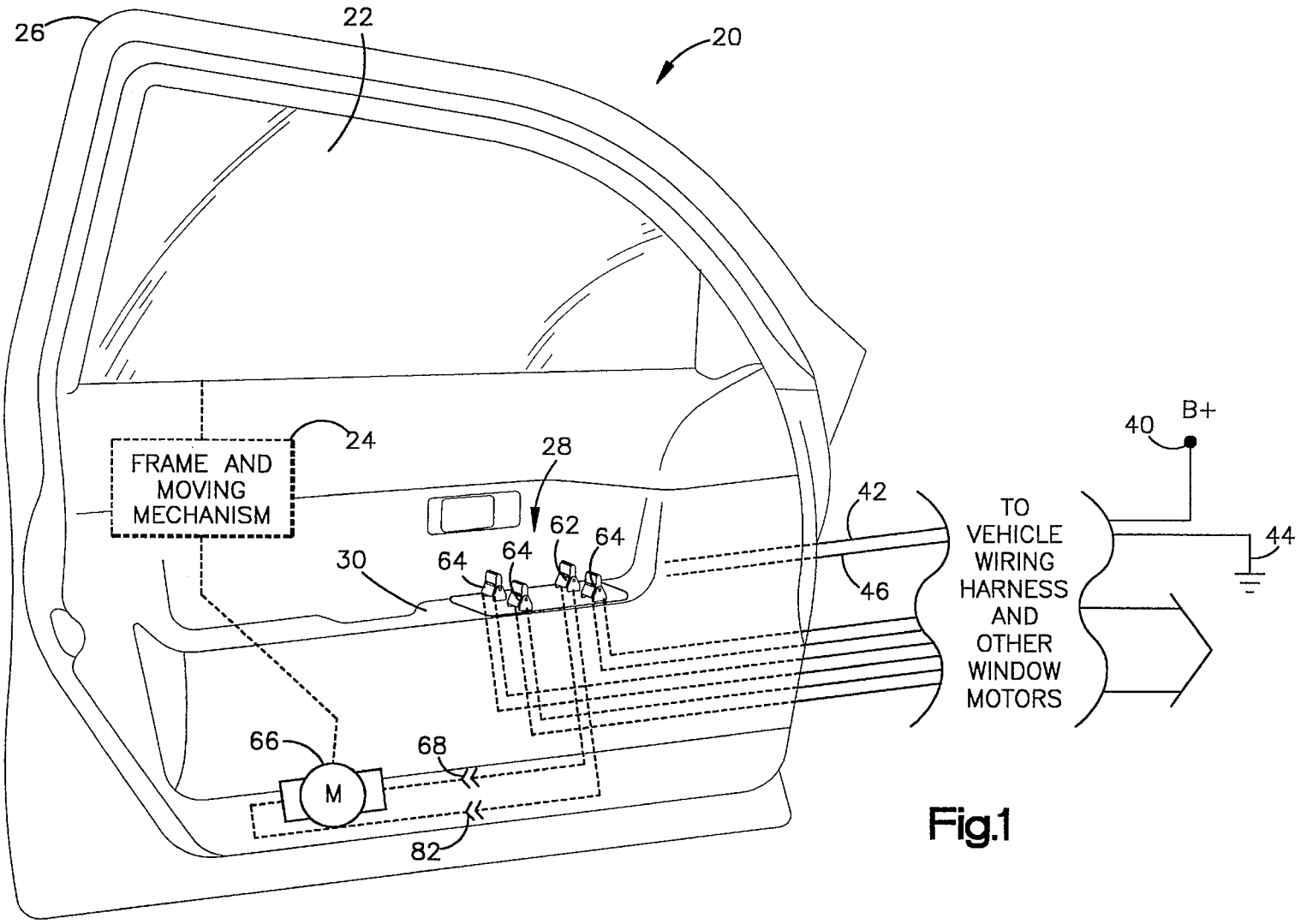
FIG. 1 is a schematic diagram illustrating a vehicle power window control system having a switch assembly embodying the present invention.

A vehicle power window system 20 (FIGS. 1 and 2) includes a window 22 mounted in a movable frame and moving mechanism 24 inside of a door 26. The window 22 slidably moves in opposite directions between a fully opened position and a fully closed position. A master control assembly 28 is mounted in an arm rest 30 of the door 26 near a seat (not shown) for a driver of the vehicle to manipulate.

The master control assembly 28 provides the driver of the vehicle with the ability to control the position and the movement of each of the windows 22 of the vehicle. The master control assembly 28 is electrically connected to a source of vehicle power 40 (B+) through a conductor 42 and a chassis or frame connection 44 (ground) through a conductor 46. The master control assembly 28 includes a plurality of individual switch assemblies 62, 64.

Each of the switch assemblies 62, 64 is pivotable in opposite directions to effect movement of an associated window 22 of the vehicle. Each of the switch assemblies 62, 64 is resiliently biased to return to a centered or neutral position at which movement of the window 22 is not effected. In the illustrated embodiment, one switch assembly 62 of the master control assembly 28 incorporates all features of the present invention. The master control assembly 28 also includes three switch assemblies 64. It will be apparent that any alternate combination of the switch assemblies 62, 64 can be used in the master control assembly 28.

The switch assembly 62, embodying the present invention, controls the operation of the window 22 adjacent the driver position. The switch assemblies 64 control the windows 22 located remotely away from the driver, such as the window located adjacent a front seat passenger position and the windows adjacent the back seat passenger positions. All of the switch assemblies 62, 64 are capable of "manual" control of the movement of an associated window 22. The switch assembly 62 is also capable of "automatic" control of the movement of the window 22 adjacent the driver position.

Each of the switch assemblies 62, 64 is electrically connected to a respective electric motor 66 to control operation of the motor. The motor 66 is operatively connected to the frame and moving mechanism 24 supporting the window 22. The motor 66 cooperates with the frame and moving mechanism 24 to move the window 22 between the fully open position and the fully closed position when the motor is energized. The source of electrical power 40 is electrically connected to an ignition switch 84. The electric motor 66 is a DC motor capable of bi-directional rotation.

Figure 6:
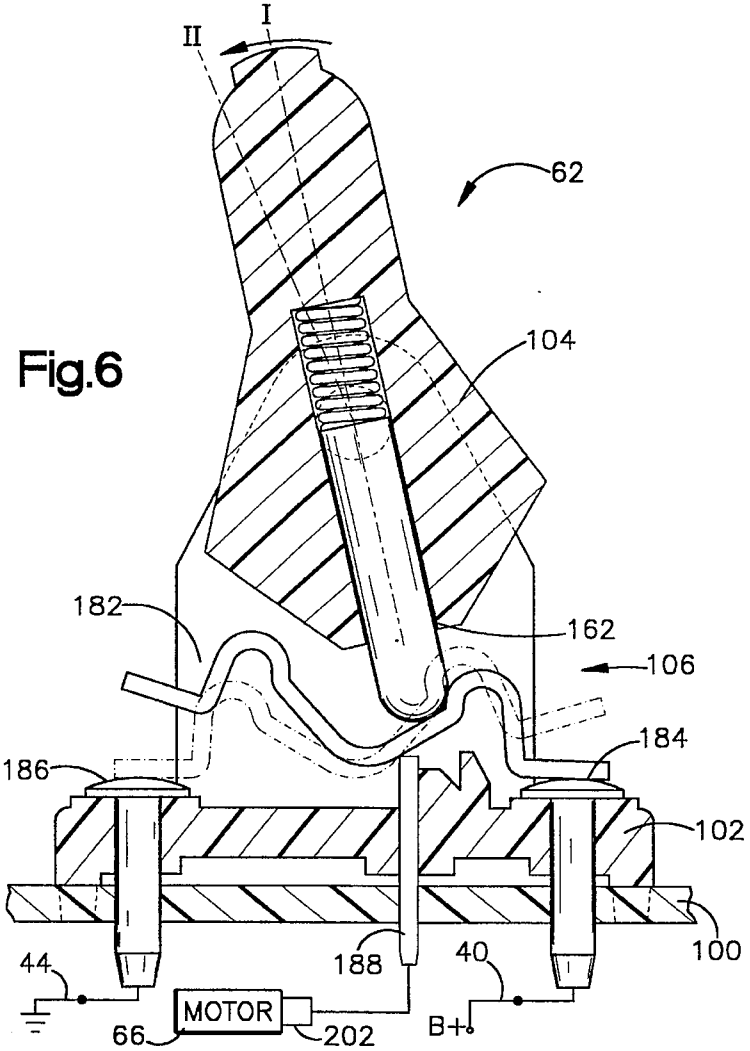
FIG. 6 is a view similar to FIG. 5 illustrating parts in different positions.
Figure 7:
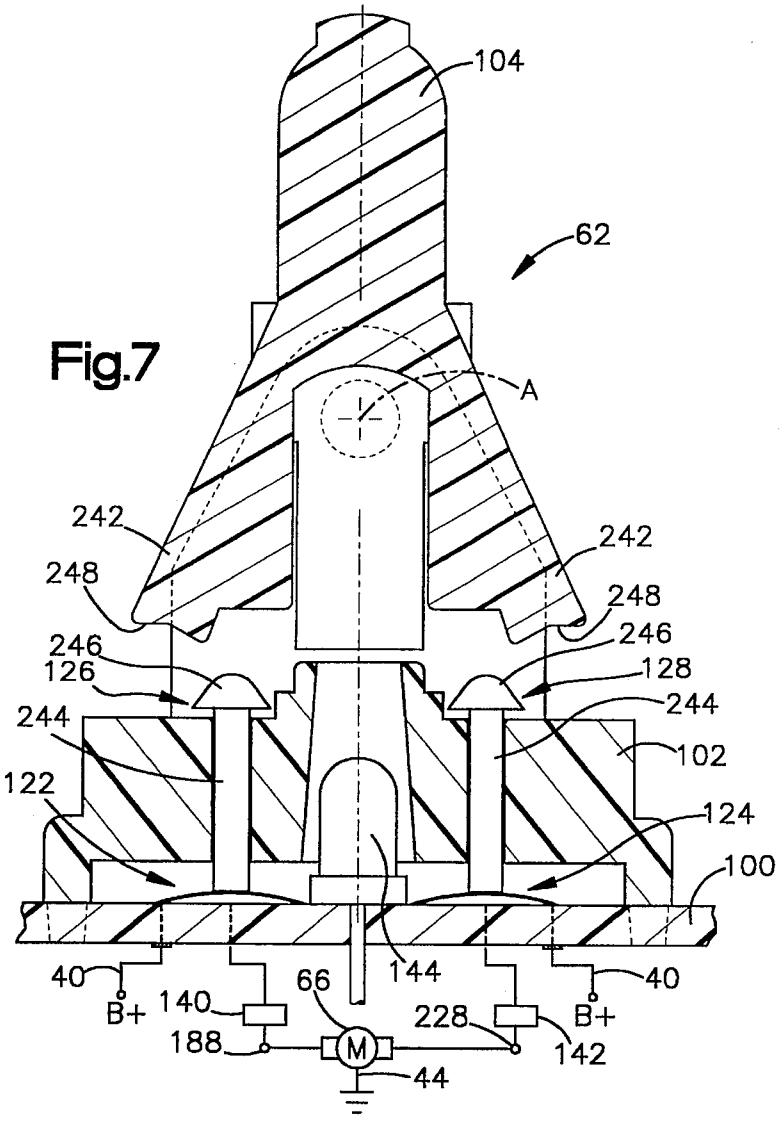
FIG. 7 is a schematic view, partly in section, of the switch assembly of FIG. 4, taken approximately along the line 7—7 in FIG. 4, and illustrating a disk contact portion.

The switch assembly 62 (FIGS. 4–10) is mounted to a printed circuit board 100 (FIG. 4) of the master control assembly 28. The switch assembly 62 (FIGS. 4, 5 and 7) includes a base 102, a lever 104, a pair of rocker switches 106, 108, a pair of dome switches 122, 124 (FIG. 7), a pair of plungers 126, 128, a pair of hold circuits 140, 142 (FIG. 3) and an LED 144 (FIG. 7). The base 102 of the switch assembly 62 is received on the printed circuit board 100. The lever 104 is supported by the base 102 for pivotal movement in opposite directions from the centered or neutral position illustrated in FIG. 5 about an axis A (FIGS. 4 and 5) of the switch assembly 62.

A series of metal switch terminals protrude from the base of the switch and through corresponding holes in the printed circuit board 100. The switch terminals are soldered to circuit traces carried by the printed circuit board 100. All electrical signals into and out of the switch assembly 62 are coupled to the switch terminals through the circuit traces.

Figure 2:
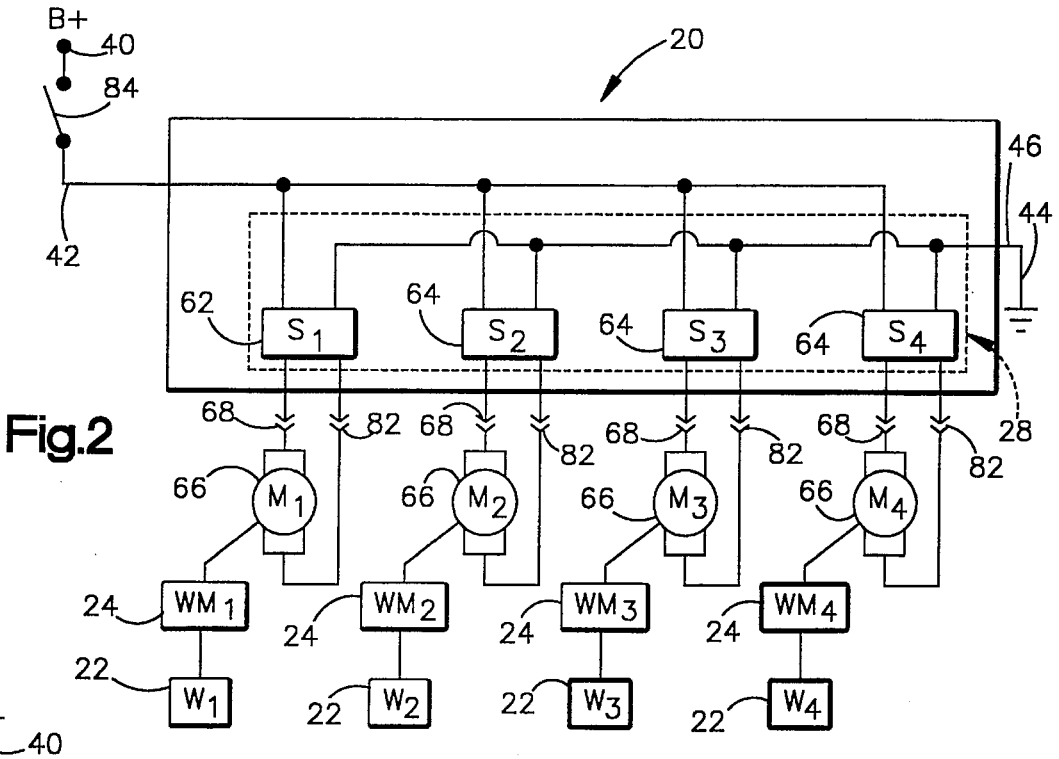
FIG. 2 is a functional block diagram of the system of FIG. 1.
Figure 3:
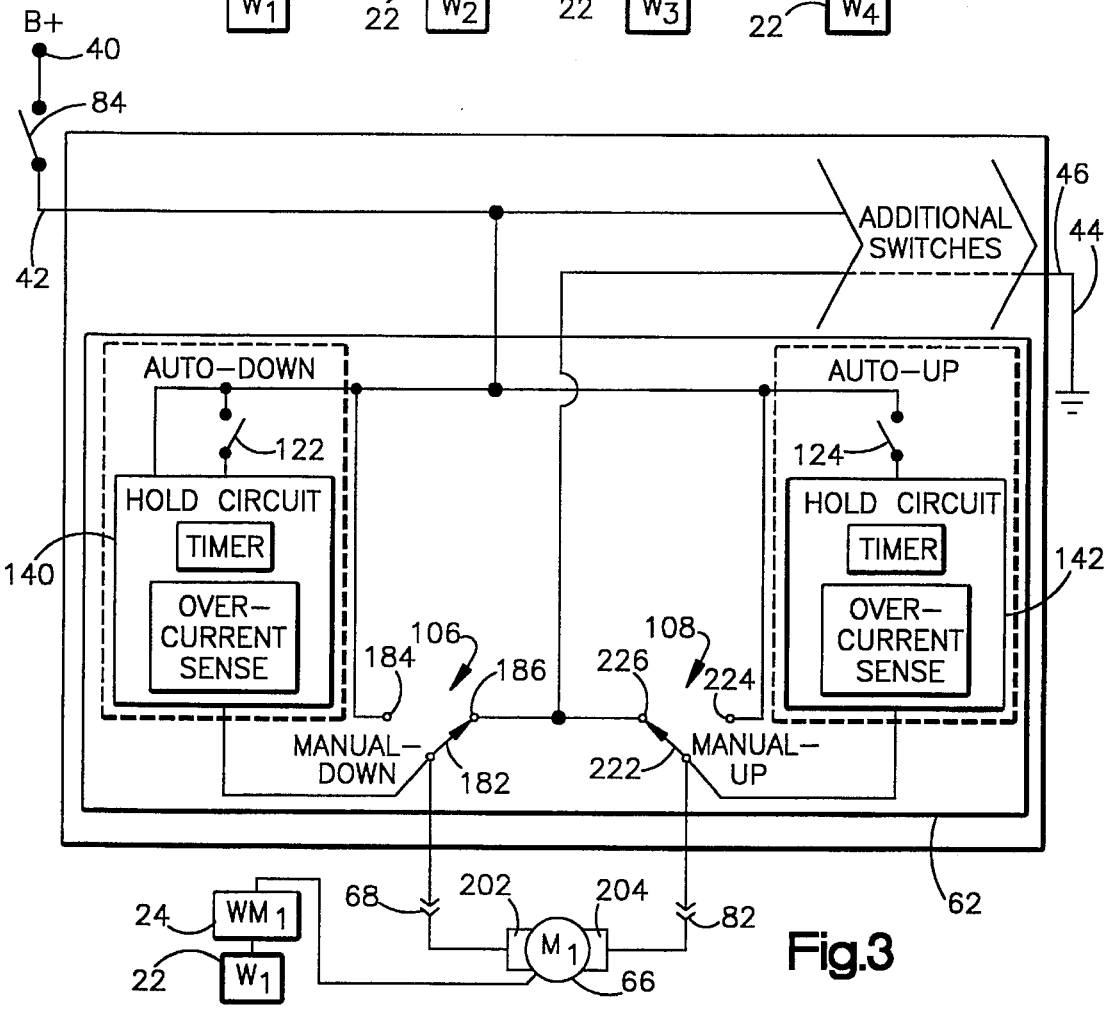
FIG. 3 is a schematic representation of a portion of the control system of FIG. 2.

The pair of rocker switches 106, 108 are spaced apart in the switch assembly 62 in a direction taken parallel to the axis A. The rocker switches 106, 108 are electrically connected to the electric motor 66 associated with the switch assembly 62, as illustrated in FIGS. 2 and 3. Each of the rocker switches 106, 108 is used for "manual" control of the movement of an associated window 22 in opposite directions. The pair of dome switches 122, 124 are electrically connected with the hold circuits 140, 142 which are also electrically connected with the motor 66 for "automatic" control of the movement of the associated window 22 to the fully opened and fully closed positions.

The base 102 supports the switches 106, 108, 122, 124. The hold circuits 140, 142 apply power under certain conditions to function in "auto-up" and "auto-down" modes. The hold circuits 140, 142 maintain the energization of the motor 66 after the dome switches 122, 124 become electrically conductive, at least momentarily and then become nonconductive.

The hold circuits 140, 142 (FIG. 3) may be any type of suitable circuit that maintains the energization of the motor 66 to rotate in a desired direction for a predetermined duration. The predetermined duration can be for a fixed amount of time or until an "overcurrent" condition of the motor 66 is sensed. The overcurrent condition is indicative of the window 22 being moved to the fully open position, the fully closed position or at some intermediate position at which the window becomes stuck.

Figure 5:
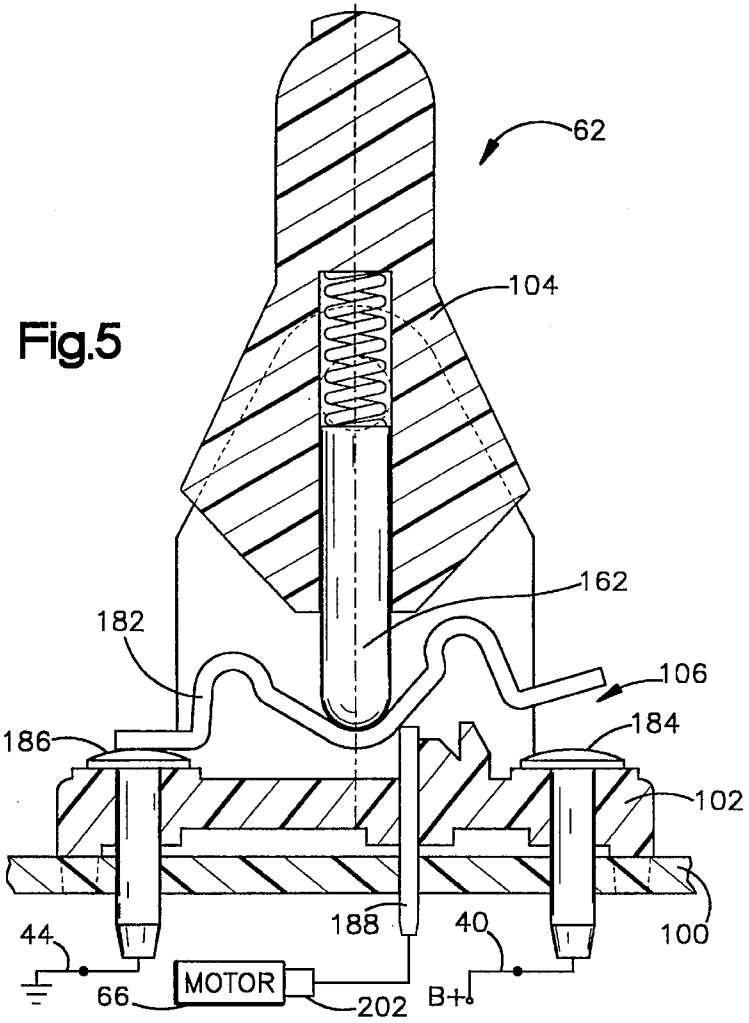
FIG. 5 is a schematic view, partly in section, of the switch assembly of FIG. 4, taken approximately along the line 5—5 in FIG. 4, and illustrating a rocker switch portion.

The lever 104 is manually depressed to pivot in one of two opposite directions about the axis A from the centered or neutral position, as illustrated in FIGS. 5 and 7. The lever 104 is pivotable in one direction, for example counterclockwise as viewed in FIG. 6, to a first actuating position (I). The first actuating position (I) is not quite to the end limit of the pivotable travel of the lever. When in this first actuating position (I), the rocker switch 106 "manually" energizes the motor 66. The motor 66 is then energized to rotate in a first direction only so long as the lever 104 is manually held in the first actuating position (I). Energization of the motor 66 is accomplished through the rocker switch 106, which is actuated or electrically connected to the source of electrical power 40, when the lever 104 is in the first actuating position (I) to thereby provide electrical power to the motor 66.

The lever 104 can also be pivoted somewhat further in the same direction (counterclockwise) to a second actuating position (II) at or near the limit of pivoting travel. The second actuating position (II) of the lever 104 actuates or "closes" the dome switch 122, thereby supplying power to hold circuit 140. The dome switch 122 only has to be momentarily actuated to trigger the hold circuit 140. The hold circuit 140 continues the energization of the motor 66 even after the lever 104 is released from the second actuating position (II) and has returned to the neutral position.

The lever 104 is manually pivotable in the opposite direction about the axis A (clockwise, as viewed, in FIG. 6A) to a third actuating position (III). The third actuating position (III) of the lever 104 is not quite to the end limit of the pivotable travel of the lever in that direction and effects the energization of the motor 66. The switch assembly 62 is then in the "manual-up" mode of operation and energizes the motor 66 to rotate in a second direction so long as the lever 104 is manually held in the third actuating position. The motor energization is accomplished through rocker switch 108, which is actuated when the lever 104 is in the third actuating position (III) to thereby provide electrical power to the motor 66.

The lever 104 can also be manually pivoted in the same clockwise direction to a fourth actuating position (IV) at or near the limit of travel. The fourth actuating position (IV) actuates or "closes" the dome switch 124 thereby supplying power to hold circuit 142. The dome switch 124 only has to be momentarily actuated to trigger the hold circuit 142. The hold circuit 142 continues the energization of the motor 66 even after the lever 104 is released and has returned to the neutral position.

The rocker switches 106, 108 are actuated to become electrically conductive to deliver electrical power to the motor 66 only as long as the lever 104 is held in the first or third actuating position. The rocker switches 106 and 108 thus "manually" control up or down movement of the window 22. The dome switches 122, 124 are actuated when the lever 104 is moved to the second or fourth actuating position to trigger the respective hold circuit 140 or 142 so electrical power is applied to the motor 66 for a predetermined period. The dome switches 122 and 124 thus control "automatic" movement of the window 22.

Figure 6A:
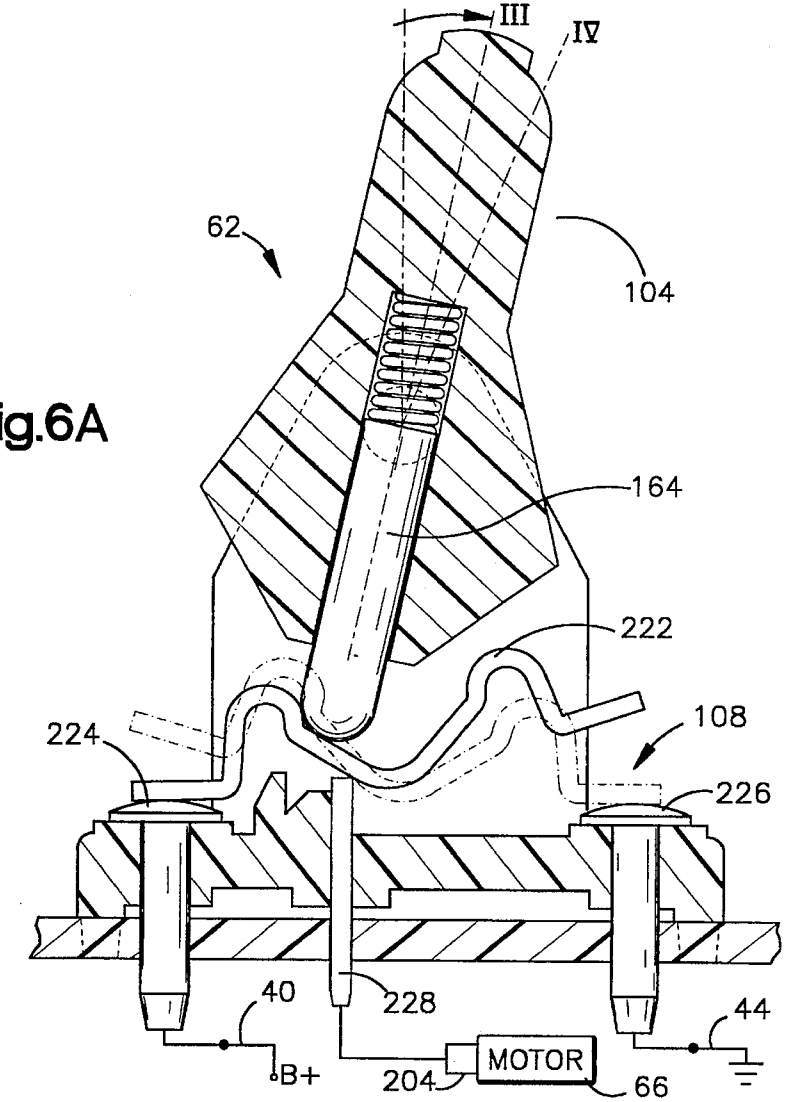
FIG. 6A is a schematic view, partly in section, of the switch assembly of FIG. 4, taken approximately along the line 6A—6A in FIG. 4, and illustrating another rocker switch portion.

The lever 104 is initially in the centered or neutral position, as illustrated in FIGS. 5 and 7. When the lever 104 is in the neutral position, switches 106, 108, 122, 124 are not actuated and are not providing electrical power to the motor 66. The lever 104 carries a pair of spring biased pins 162, 164 (FIGS. 5, 6, and 6A). The rocker switch 106 (FIGS. 5 and 6) includes a generally "M-shaped" moving rocker contact 182, a positive contact 184, a ground contact 186 and a pivot stand 188. The positive contact 184 of the rocker switch 106 is electrically connected to the source of electric power 40 (FIG. 3). The ground contact 186 is electrically connected with the vehicle chassis or ground connection 44 through the traces on the printed circuit board 100. The moving rocker contact 182 is electrically connected to the terminal 202 of the electric motor 66 through the pivot stand 188 and connector 68. The connector 68 is mounted on printed circuit board 100 and is not shown in FIG. 5.

The spring biased pin 162 applies a downward force to normally urge the moving rocker contact 182 downwardly to engage the pivot stand 188 and to engage the ground contact 186. When the lever 104 is pivoted to the first actuating position, as illustrated in FIG. 6, the moving rocker 182 pivots in a clockwise direction about the pivot stand 188 to disengage the ground contact 186 and engage the positive contact 184. This, in turn, causes energization of the motor 66 and movement of the window 22 in a downward direction towards the fully open position.

The rocker switch 108 (FIG. 6A) includes a generally "M-shaped" moving rocker contact 222, a positive contact 224, a ground contact 226 and a pivot stand 228. The spring biased pin 164 applies a downward force to normally urge the moving rocker contact 222 downwardly to engage the pivot stand 228 and the ground contact 226. When the lever 104 is pivoted to the third actuating position, as illustrated in FIG. 6A, the moving rocker contact 222 pivots counterclockwise about the stand 228 to disengage the ground contact 226 and engage the positive contact 224. This, in turn, causes the energization of the motor 66 and movement of the window in an upward direction towards the fully closed position.

The positive contact 224 of rocker switch 108 is electrically connected to the source of electric power 40 (FIG. 3). The ground contact 226 is electrically connected with the vehicle chassis or ground connection 44 through the conductor 46. The moving rocker 222 of rocker switch 108 is electrically connected to the terminal 204 of motor 66 through the pivot stand 228 and connector 82.

Upon the pivoting of the lever 104 to the first actuating position (I, manual down), the moving rocker contact 182 of the rocker switch 106 engages the positive contact 184 for electrical communication with the stand 188. The moving contact 182 breaks conductive engagement with ground contact 186. The moving rocker contact 222 of the rocker switch 108 remains in engagement with the ground contact 226. The supply of power through the motor 66 is from the positive contact 184 of the rocker switch 106 through the moving rocker contact 182, to the stand 188, through the connector 68, to the terminal 202, and exits the motor through the terminal 204, through the connector 82, to the stand 228 of the rocker switch 108, through the moving rocker contact 222 and to the ground contact 226. The flow of electrical power in this manner will cause motor 66 rotation in the first direction. The first direction of rotation of the motor 66 moves the window 22 in the down direction towards the fully open position.

When, on the other hand, lever 104 is pivoted in the opposite direction to the third actuating position (III, manual up) the moving rocker contact 222 of rocker switch 108 conductively engages the positive contact 224. The moving rocker contact 182 of the rocker switch 106 remains in conductive contact with ground contact 186. The supply of power through the motor 66 is from the positive contact 224, through the moving rocker contact 222, through the stand 228, to the terminal 204 of the motor, through the connector 82, and exits the motor at terminal 202, through connector 68, to the stand 188 of the rocker switch 106, through the moving rocker contact 182 and to the ground contact 186 of the rocker switch 106. The supply of electrical power in this manner will cause the motor 66 to rotate in the second direction. The second direction of rotation of the motor 66 raises, and thus closes, the window 22. It should be apparent that operation of the lever 104 of the switch assembly 62 engages just one of the moving rocker contacts 182 or 222 of the rocker switch 106 or 108, at a time to be in electrical contact with the associated positive contact 184 or 224 while the moving rocker contact 222 or 182 of the other rocker switch 108 or 106 remains engaged with the associated ground contact 226 or 186.

The dome switches 122, 124 (FIGS. 7 and 8) are carried on the printed circuit board 100 immediately beneath the base 102 of the switch assembly switch 62. Each dome switch 122, 124 includes a first outer ring contact 282 (FIGS. 9 and 10) and a second inner circular contact 284 located coaxially within the ring-shaped contact. A conductive disk 286 is preferably made of a resiliently deflectable metal material and is located coaxially with the outer and inner contacts 282, 284. The disk 286 includes a periphery 288 and a dome portion 290 which is preferably a section of a sphere. The disk 286 engages the outer contact 282 at least at a portion of the periphery 288 of the disk and is affixed to the printed circuit board 100 and the outer contact by suitable means 292, such as tape or solder. The disk 286 is deflectable into engagement with the inner contact 284.

Figure 4:
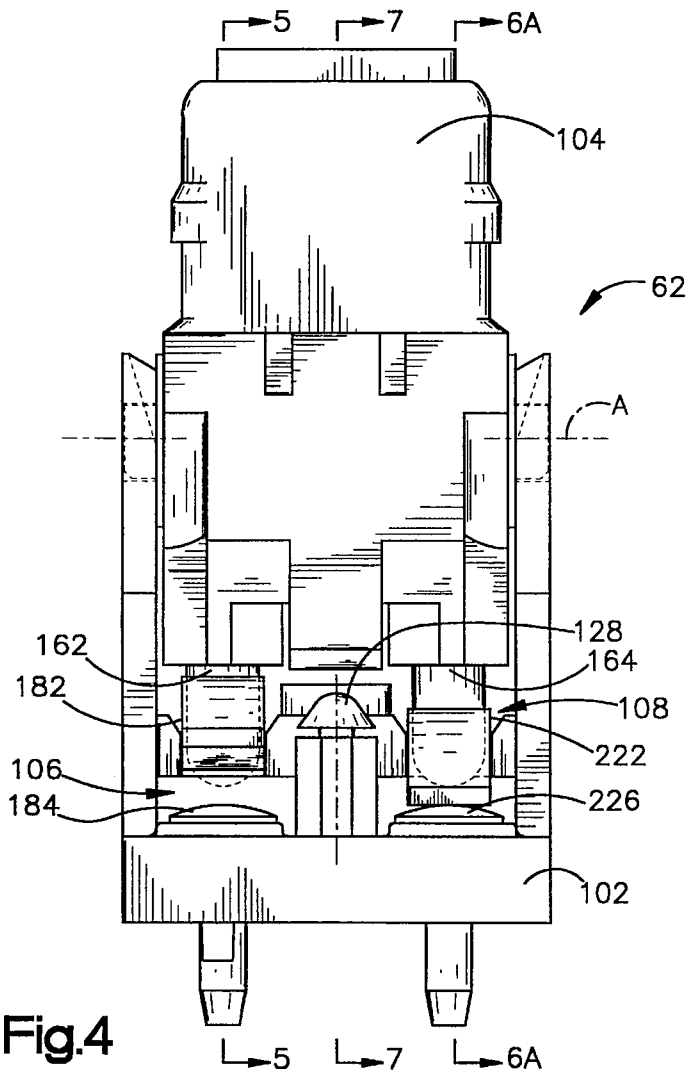
FIG. 4 is a front elevation view of the switch assembly of FIG. 1.

The plunger 126 is located above the dome switch 122. Similarly, the plunger 128 is located above the dome switch 124. Each of the plungers 126, 128 is movable in a direction which is linear and perpendicular to the dome portion 290 of the disk 286. Each of the plungers 126, 128 has an elongated body 244 received in a passage in the base 102 for reciprocal linear movement. Each of the plungers 126, 128 also includes an end portion 246 with an enlarged mushroom-shaped head located at the upper end of the body 244. As best seen in FIG. 4, plungers 126, 128 are carried in passages formed along the centerline of the base 102, between the rocker switches 106 and 108.

As illustrated in FIG. 7, the lever 104 has a pair of actuator arms 242 on opposite sides of the lever. Each of the actuator arms 242 of the lever 104 includes a concave end surface 248 which is V-shaped to engage, slide along and depress the end portion 246 of the respective plunger 126, 128.

Figure 8A:
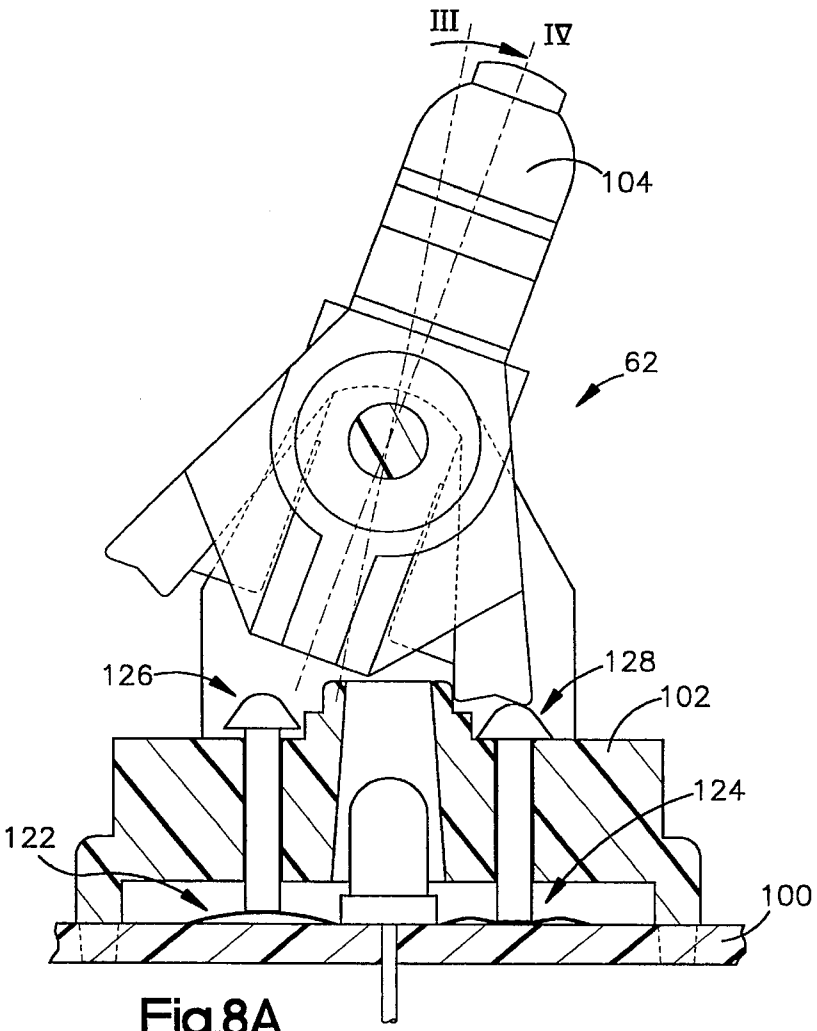
FIGS. 8 and 8A are views similar to FIG. 7 illustrating parts in different positions.
Figure 8:
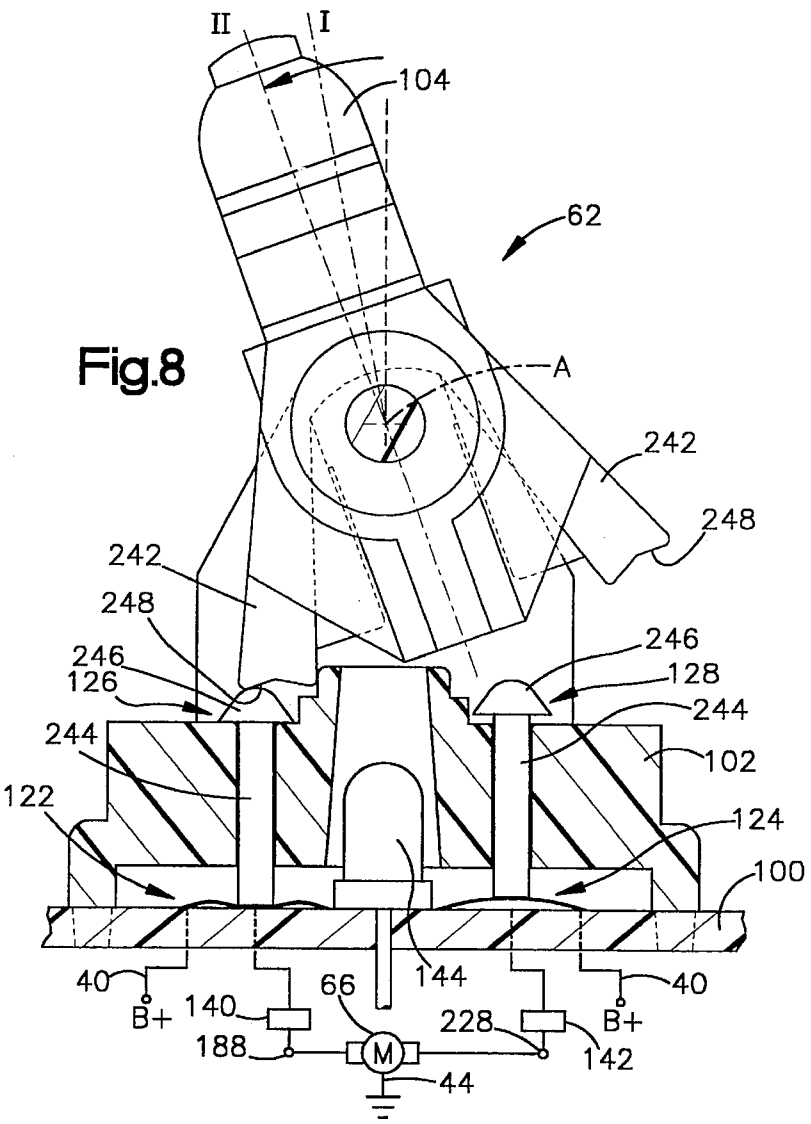
Figure 9:
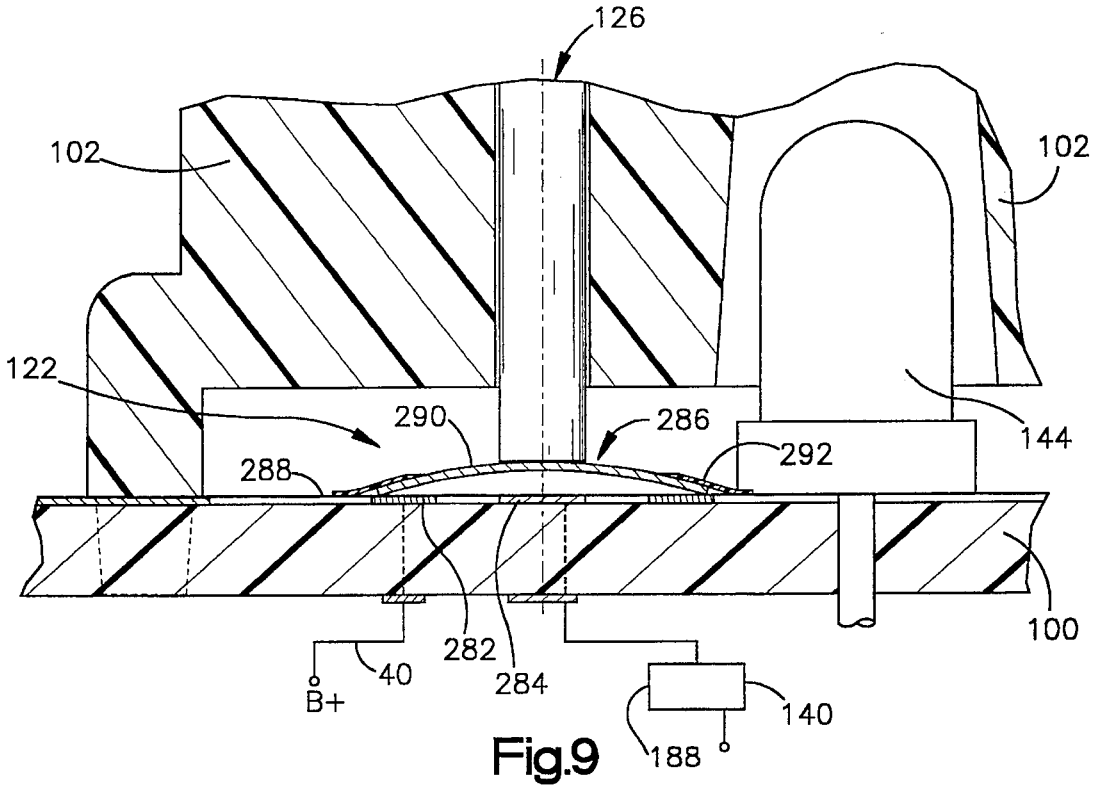
FIG. 9 is an enlarged sectional view of the disk contact portion of FIG. 7.
Figure 10:
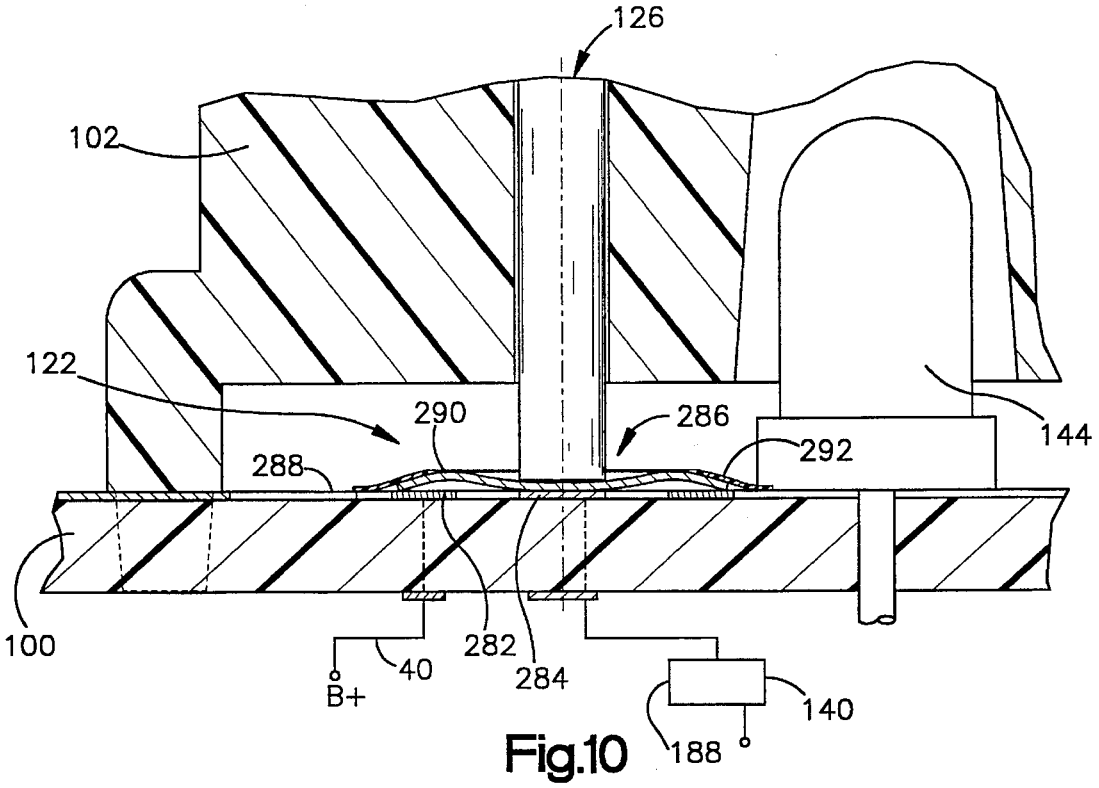
FIG. 10 is a view similar to FIG. 9 with parts illustrated in different positions.

When the lever 104 is pivoted to the second actuating position, as illustrated in FIG. 8, the plunger 126 is linearly moved in a downward direction, as viewed in FIG. 9. The plunger 126 is moved in a direction substantially normal to the disk 286 to deflect domed portion 290 of the disk into engagement with the inner contact 284 (FIG. 10). This closes the dome switch and activates the hold circuit 140. Upon release of the lever 104 the plunger 126 is moved upwards by the resilience of the disk 286 to a position in which the dome switch 122 is no longer conductive. However, the hold circuit 140 continues energizing the motor 66 for the predetermined period.

When the lever 104 is pivoted, at least momentarily to the fourth actuating position, as illustrated in FIG. 8A, the dome switch 124 is actuated. The plunger 128 is moved downwardly to deflect the disk 286 of the dome switch 124 to engage the inner contact 284 and activate the hold circuit 142. Upon release of the lever 104, the plunger 128 moves upwards by the resilience of the disk 286 to a position in which the dome switch 124 is no longer conductive but the hold circuit 142 continues energizing the motor 66.

Upon actuation of the switch 122 the hold circuit 140 is activated and is in electrical communication with the pivot stand 188 to provide electrical power to the motor 66 and move the window 22 to the fully open position. When the switch 124 is actuated the hold circuit 142 is activated and is in an electrical communication with the stand 228 to conduct electrical power to the motor 66 and move the window 22 to the fully closed position.

A fully modular switch assembly 62 has thus been described which has rocker contact switches 106, 108 for full manual up/down control of a power window, and integral momentary closure dome switches 122, 124 for triggering auto up/down circuits. The design is compact and flexible. The switch assembly 64 can be a modified form of the switch assembly 62 for manual window motor control, alone, by simply omitting the dome switches 122, 124 and plungers 126, 128 or by not providing or connecting the hold circuits 140, 142.

From the above description of the invention, those skilled in the art will perceive improvements, changes and modifications. Such improvements, changes and modifications within the skill of the art are intended to be covered by the appended claims.

Having described the invention, the following is claimed:

1. An apparatus for operating a vehicle window in an auto-down mode, said apparatus comprising:

a mechanism adapting to support a vehicle window;

an energizable electric motor coupled with said mechanism and for moving the window between fully open and fully closed positions;

actuatable circuit means for, upon actuation, energizing said motor and for maintaining the energization of said motor for a predetermined time after initial actuation of said circuit means; and a switch assembly comprising:

a first electrical contact;

a second electrical contact electrically insulated from said first electrical contact;

an electrically conductive disk having a periphery and a domed portion, said disk being in electrical communication with one of said first and second electrical contacts at said periphery, the other of said first and second electrical contacts located adjacent said disk and initially spaced from said disk, said domed portion being resiliently deflectable into contact with the other of said first and second electrical contacts to provide electrical communication between said first and second electrical contacts and initially actuate said circuit means;

a plunger supported for linear movement along a longitudinal axis of said plunger; and a lever supported for pivotable movement to move said plunger and deflect said domed portion of said disk into contact with said other of said first and second electrical contacts.

2. The apparatus of claim 1 further including rocker assembly and wherein said lever is manually pivotable to a manual actuation position at which said rocker assembly energizes said electric motor when said lever is maintained in the manual actuation position.

3. The apparatus of claim 1 wherein said plunger includes an end portion having a convex surface and wherein said lever includes an actuator arm having an end portion with a concave V-shaped surface for engaging said end portion of said plunger to move said plunger.

4. An apparatus for controlling movement of a vehicle window between a fully open position and a fully closed position, the window is operably coupled with an energizable electric motor for, when energized, moving the window, said apparatus comprising:

means for energizing the electric motor to move the window toward one of the fully open and fully closed positions, said means for energizing said electric motor including:

a first electrical contact;

a second electrical contact electrically insulated from said first electrical contact;

an electrically conductive disk having a periphery and a domed portion, said disk being in electrical communication with one of said first and second electrical contacts at said periphery of said disk, the other of said first and second electrical contacts located adjacent said disk and initially spaced from said disk, said domed portion being resiliently deflectable into engagement with the other of said first and second electrical contacts to provide electrical communication between said first and second electrical contacts to energize said electric motor;

a first member supported for movement and being movable in response to manual force applied thereto to effect, upon movement to a predetermined position, deflection of said domed portion into engagement with the other of said first and second electrical contacts of said disk; and means for maintaining energization of said electric motor after said domed portion of said disk disengages said other of said first and second contacts.

5. The apparatus of claim 4 further including a rocker assembly which moves the window in a direction towards the fully open position when said first member is held in a first intermediate position in one direction between a neutral position of said first member at which said electric motor is unenergized and the predetermined position of said first member.

6. The apparatus of claim 5 further including a second rocker assembly and a second electrically conductive disk and wherein said first member is pivotable in a direction opposite to the one direction to a second intermediate position and further to a second predetermined position, the second intermediate position of said first member actuates said second rocker assembly to move the window in a direction towards the fully closed position only when said second member is held in the second intermediate position and wherein the second predetermined position of said first member causes said second disk to energize said electric motor to move the window to the fully closed position.

7. Apparatus for moving a vehicle window between a fully open position and a fully closed position, said apparatus comprising:

an energizable electric motor for, when energized, moving the window;

switch means for energizing said electric motor to move the window in a direction towards one of the fully open and fully closed positions, said switch means including a dome switch comprising:

a first electrical contact;

a second electrical contact electrically insulated from said first electrical contact;

an electrically conductive disk having a periphery and a domed portion, said disk being in electrical communication with one of said first and second electrical contacts at said periphery of said disk, the other of said first and second electrical contacts located adjacent said disk and initially spaced from said disk, said domed portion being resiliently deflectable into engagement with the other of said first and second electrical contacts to provide electrical communication between said first and second electrical contacts and energize said electric motor;

a first member supported for movement in response to manual force applied thereto; and a second member supported for movement in response to movement of said first member to a predetermined position in one direction to deflect said domed portion of said disk into engagement with the other of said first and second electrical contacts; and means for maintaining energization of said electric motor after said domed portion of said disk disengages said other of said first and second contacts.

8. An electrical switch comprising:

a base;

a rocker switch supported by said base and having a ground contact terminal, a positive contact terminal for electrical connection to a source of electric power, and a pivot contact terminal for electrical connection to an electrical load, said rocker switch including a conductive rocker contact, said conductive rocker contact being movable from a first position for electrically connecting said ground contact terminal to said pivot contact terminal and to a second position for electrically connecting said positive contact terminal to said pivot contact terminal;

a dome switch adapted to be supported adjacent said base and being spanned by said base, said dome switch including a first electrical contact, a second electrical contact, and an electrically conductive disk having a periphery and a domed portion, said periphery being in electrical contact with one of said first and second electrical contacts, the other of said first and second electrical contacts located adjacent said disk and initially spaced from said disk, said domed portion being resiliently deflectable into engagement with the other of said first and second electrical contacts for electrically connecting said first and said second contacts;

a first member supported by said base for pivotable movement from a neutral position to a limit position in one direction, said first member having an intermediate position between the neutral and limit positions, said conductive rocker contact electrically connecting said positive contact terminal to said pivot contact terminal in response to pivotable movement of said first member from the neutral position to the intermediate position; and a second member supported for linear movement in said base adjacent said dome switch and movable in response to said first member being pivoted to the limit position, said second member moving to engage said dome switch to deflect said dome to electrically connect said first and second electrical contacts when said first member is pivoted to the limit position.

* * * * *